US006309336B1

(12) United States Patent
Muessig et al.

(10) Patent No.: US 6,309,336 B1
(45) Date of Patent: Oct. 30, 2001

(54) APPARATUS FOR FOLDING A PORTION OF A TEXTILE LENGTH

(75) Inventors: Karl Muessig; Guido Erhart, both of Bad Koenigshofen (DE)

(73) Assignee: Texpa Maschinenbau GmbH & Co. (DE)

( * ) Notice: Subject to any disclaimer, the term of this patent is extended or adjusted under 35 U.S.C. 154(b) by 0 days.

(21) Appl. No.: 09/285,142

(22) Filed: Apr. 1, 1999

(30) Foreign Application Priority Data

Apr. 3, 1998 (DE) ..... 198 14 917

(51) Int. Cl.[7] ..... B31F 1/10

(52) U.S. Cl. ..... 493/444; 493/405; 493/417; 493/423; 493/437; 493/457

(58) Field of Search ..... 493/405, 417, 493/421, 444, 437, 441, 423, 457

(56) References Cited

U.S. PATENT DOCUMENTS

| | | | | |
|---|---|---|---|---|
| 1,620,444 | * | 3/1927 | Davidson | 493/444 |
| 3,749,394 | * | 7/1973 | McCain et al. | 493/444 |
| 3,897,051 | * | 7/1975 | Muller | 493/444 |
| 4,419,088 | * | 12/1983 | Nemec | 493/444 |
| 4,643,705 | * | 2/1987 | Bober | 493/444 |
| 5,540,647 | * | 7/1996 | Weiermann et al. | 493/444 |

FOREIGN PATENT DOCUMENTS

| | | |
|---|---|---|
| 31 10 002 A1 | 2/1982 | (DE) . |
| 39 04 385 A1 | 8/1990 | (DE) . |
| 41 26 489 C2 | 4/1993 | (DE) . |

* cited by examiner

*Primary Examiner*—Peter Vo
*Assistant Examiner*—Louis K. Huynh
(74) *Attorney, Agent, or Firm*—McGlew and Tuttle, P.C.

(57) ABSTRACT

An apparatus is provided for folding a portion of a textile length, in particular a bed sheet or similar, with a lengthwise folding device (16) in which the textile length is folded to produce a tubular folded product (2) with lengthwise folding edges extending substantially parallel to one another, and a crosswise folding device (1) in which the tubular folded product (2) is folded to produce a folded product in packet form with at least one crosswise folding edge (14) extending substantially perpendicularly to the lengthwise folding edges. The tubular folded product (2) can be brought to lie with one lengthwise edge against a stop strip (23, 24), at least in certain regions, in the crosswise folding device (1) before being folded. A drawing device (12) is disposed in the region between the two ends of the tubular folded product in order to draw in the folded product for crosswise folding. A thrust device (30) is disposed in the crosswise folding device (1), which thrust device can be brought to lie against the folded product (2), at least in certain regions, while the tubular folded product (2) is being drawn into the drawing device (12) and exerts a thrust force component (21, 22) directed substantially perpendicularly to the stop strip (23, 24) on the folded product (2), so that the free ends of the folded product (2) cannot shift.

15 Claims, 2 Drawing Sheets

APPARATUS FOR FOLDING A PORTION OF A TEXTILE LENGTH

FIELD OF THE INVENTION

The invention relates to an apparatus for folding a portion of a textile length, in particular a bed sheet or similar, with a lengthwise folding device in which the portion of a textile length is folded to produce a tubular folded product with lengthwise folding edges extending substantially parallel to one another, and a crosswise folding device in which the tubular folded product is folded to produce a folded product in packet form.

BACKGROUND OF THE INVENTION

Apparatus of this type are used in particular, although by no means exclusively, for mechanically folding bed sheets so that these can be packed in packet form. After the bed sheets have been cut to size and sewn, the lengths of fabric, which are spread out flat, are fed into a lengthwise folding device in which they are folded to produce a tubular folded product with lengthwise folding edges extending substantially parallel to one another. The basic structure of folding devices of this kind is known from the prior art. The tubular folded product is then conveyed into a crosswise folding device in which it is folded with crosswise folding edges extending substantially perpendicularly to the lengthwise folding edges. The folded product is thus given the desired packet form in which it can sequently be packed.

A stop strip, against which the tubular folded product comes to lie, at least in certain regions, before being folded, is disposed in the crosswise folding device. The stop strip forms an end stop for the conveying movement of the folded product when the latter is fed into the crosswise folding device and ensures that it has a defined orientation before crosswise folding takes place.

A drawing device is disposed in the crosswise folding device in the region between the two ends of the tubular folded product in order to draw in the folded product for crosswise folding. After the folded product has been conveyed completely into the crosswise folding device and come to lie in a defined manner against the stop strip, it is drawn in by the drawing device in the central region, whereby the first crosswise fold is formed and the folded product therefore folded crosswise once.

The disadvantage of known folding apparatus lies in their inadequate folding accuracy in crosswise folding in the crosswise folding device. Since a plurality of fabric layers already lie on top of one another as a result of the lengthwise folding process in the lengthwise folding device, the folded product tends to become distorted in the drawing-in region when being drawn into the drawing device such that the free ends of the folded product, which have not yet been drawn in, are displaced horizontally. Due to this shifting of the free ends of the folded product, the lengthwise edge of the folded product no longer lies properly against the stop strip while being drawn in. As a result, the folded product is no longer drawn evenly into the drawing device parallel to the stop strip, so that considerable folding inaccuracies arise when folding crosswise, in particular in subsequent folding stages. The distortion of the folded product in the drawing-in region increases with the number of fabric layers lying on top of one another. The unwanted distortion of the folded product may be increased even further if the two lengthwise edges ofthe tubular folded product have different layer thickness, i.e. a different number of fabric layers lying on top of one another.

SUMMARY AND OBJECTS OF THE INVENTION

Taking this prior art as a starting point, the primary object of the present invention is to provide an apparatus for folding a portion of a textile length which is highly accurate when folding crosswise.

According to the invention a thrust device is disposed in the crosswise folding device, which thrust device can be brought to lie against the folded product, at least in certain regions, while the tubular folded product is being drawn into the drawing device. This thrust device exerts a thrust force directed substantially perpendicularly to the stop strip on the folded product. This thrust force causes the free ends of the folded product to be pressed with one lengthwise edge against the stop strip while the latter is being drawn into the drawing device. The thrust force must in this case be precisely of a magnitude which prevents the unwanted shifting of the free ends of the folded product and at the same time excludes the possibility of the folded product being pressed too forcefully against the stop strip, which would cause the folded product to stand up at the latter.

There are basically a large number of possibilities for constructing thrust devices for applying the desired thrust force. A construction which is particularly simple and therefore inexpensive to produce is one in which the thrust device comprises at least one pressure belt on both sides of the drawing device, which belts can be brought to lie on the tubular folded product while the latter is being drawn in and travel substantially slip-free with the folded product in the direction of the drawing device. The folded product and the pressure belts do not move in exactly parallel directions during the drawing-in process, so that reaction forces directed perpendicularly to the conveying direction arise as a result in the contact surface between the pressure belt and the folded product. Tests have shown that it is not sufficient to press the folded product onto the support with the pressure belts, which extend parallel to the direction in which the folded product is conveyed, to prevent the folded product from shifting. A thrust force component of a sufficient magnitude is only achieved if the pressure belts extend at an acute angle relative to the direction in which the folded product is conveyed, with the pressure belts being oriented such that the horizontal distance between the stop strip and the pressure belts decreases in the direction of the drawing device. Because of the angular offset between the directions of movement ofthe folded product and the pressure belts, a thrust force directed perpendicularly to the stop strip acts on the free ends of the folded product during the entire drawing-in process. This thrust force is distributed evenly over the entire contact surface between the folded product and the pressure belts and prevents the free ends of the folded product from shifting.

The magnitude of the thrust force which acts on the folded product can be varied through the angular offset between the directions of movement of the pressure belts and the folded product. The greater the angle comprised between the two directions of movement, the greater the resulting thrust force. In order to achieve a sufficiently high thrust force to prevent the free ends of the folded product from shifting and at the same time prevent the folded product from being pressed too forcefully against the stop strip, the pressure belts should preferably be disposed so as to extend at an angle of 0.01° to 10°, in particular at an angle of 0.5° to 2°, relative to the direction in which the folded product is conveyed.

A particularly simple drive, which is known per se, for the folded product when it is drawn into the drawing device can be achieved if, when being drawn into the drawing device, the folded product comes to lie on a substantially horizontal roller table with drive rollers disposed so as to extend substantially perpendicularly to the conveying direction of the folded product and is put into motion by means of the drive rollers. As soon as the folded product is to be drawn into the drawing device, the drive rollers are rotated and thus ensure that the folded product is evenly conveyed towards the drawing device.

It is of no importance whether or not the pressure belts have their own drive in order to achieve the desired action on the folded product. As the pressure belts are usually only used to prevent shifting of the free ends of the folded product and not to drive the latter, it is of advantage to drive the pressure belts passively by means of frictional contact with the surface of the folded product. It is therefore unnecessary to provide a separate drive for the pressure belts. The required thrust forces in the direction of the stop strip are also produced when the press belts are driven passively by the folded product, as the pressure belts move relative to the folded product towards the stop strips.

In order to achieve the required angular offset between the conveying movement of the folded product and the pressure belts, the latter should each be deflected at two deflecting rollers which extend substantially parallel to the drive rollers of the roller table, with the central longitudinal axis of the pressure belts intersecting the respective inner deflecting roller at a shorter distance from the stop strip than the respective outer deflecting roller. This offset of the central reversal points enables the desired angular offset of the path of the pressure belts relative to the direction of movement of the folded product to be adjusted.

The bearing surfaces of the deflecting rollers should preferably comprise an at least slightly cambered region on which the pressure belts are guided in the axial direction, related to the rotational axis of the deflecting rollers. The reversal points of the pressure belts on the deflecting rollers are determined by these cambered regions, as the pressure belts are centered over this cambered region. The width of the cambered region should correspond substantially with the width ofthe pressure belt. The maximum diameter of the cared region determines the central reversal point of the pressure belt.

Different types of fabric or different folding arrangements which are to be handled on the folding apparatus require thrust forces of different magnitudes in order to exclude the possibility of the free ends of the folded product shifting. The inner and/or the outer deflecting rollers should therefore preferably be mounted so as to be axially adjustable in the direction of their rotational axis. This means that this adjustment facility enables the deflecting rollers to be displaced in their mounting transversely to the direction of movement of the pressure belts and secured in the various positions. This axial displacement of the deflecting rollers makes it possible to vary the horizontal distance of the cambered bearing surface region ofthe respective outer deflecting rollers relative to the respective inner deflecting rollers and therefore alter the thrust forces which can be caused to act on the folded product. Stepless adjustability of the rotational axes in particular is advantageous in this respect. A simple readjustment of the deflecting rollers enables the strength of the thrust force to be optimally adapted to new conditions when the apparatus is started up or the type of fabric and/or folding method is/are changed.

The action of the pressure belts when pressing the folded product against the stop strips can be further augmented if the stop strip comprises two sections which are substantially symmetrical in relation to the drawing device and are disposed such that the end ofthe sections which points towards the drawing device is set at an angle towards the folded product. Because of this arrow-like formation of the stop strip, the lengthwise edge ofthe folded product is pressed to an increasingly greater degree against the stop strip the closer it comes to the drawing device. The lengthwise edge is thus applied to the stop strip in optimum fashion just before the drawing device, so that the folded product can be drawn in with precise guidance.

The setting angle of the sections of the stop strip, related to the direction of the conveying movement, should preferably lie in the range between 0.1° and 20°. An angle of 0° in this case corresponds to a stop strip which is rectilinear throughout.

In order that the angle between the sections of the stop strip and the frame may also be altered upon changing the type of fabric which is to be handled or folding method, it is preferable if the two sections of the stop strip can be secured to the frame of the crosswise folding device in an adjustable manner.

The various features of novelty which characterize the invention are pointed out with particularity in the claims annexed to and forming a part of this disclosure. For a better understanding ofthe invention, its operating advantages and specific objects attained by its uses, reference is made to the accompanying drawings and descriptive matter in which a preferred embodiment of the invention is illustrated.

BREF DESCRIPTION OF THE DRAWINGS

DESCRIPTION OF THE PREFERRED EMBODIMENT

Figure 1:
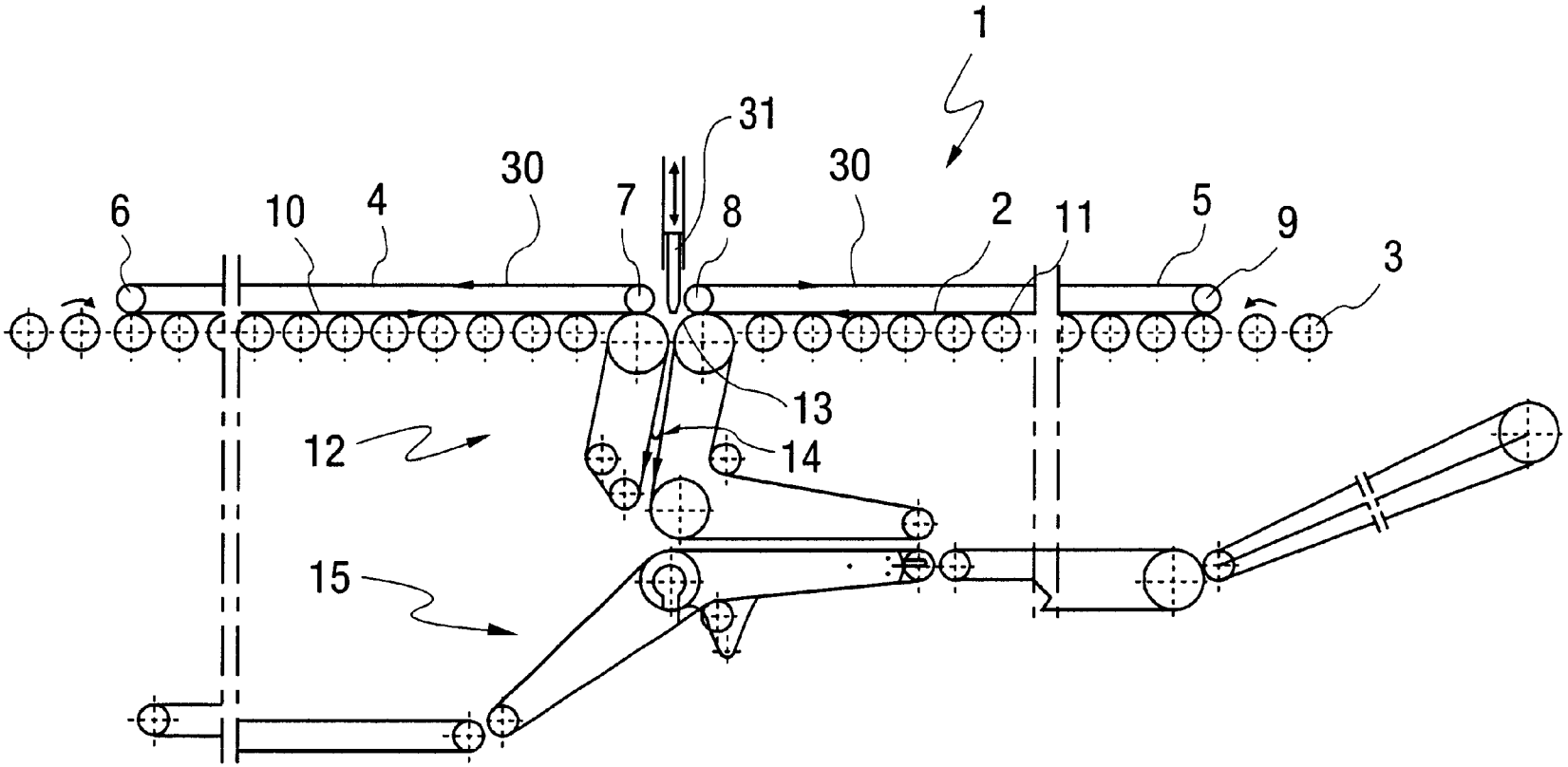
FIG. 1 is a cross sectional view showing a folding apparatus in a diagrammatic representation.

Referring to the drawings in particular, FIG. 1 shows in diagrammatic form the structure and operating mode of a folding apparatus. This figure only shows the crosswise folding device 1 of the folding apparatus, in which the tubular folded product is folded to produce a folded product in packet form with crosswise folding edges extending perpendicularly to the lengthwise folding edges. Having been fed into the crosswise folding device 1, a folded product 2 lies on the horizontally disposed drive rollers 3. After the deflecting rollers 6, 7, 8 and 9 have been moved vertically downwards in a frame, which is not shown, a pressure belt 4 and a pressure belt 5 lie from above on the two free ends 10 and 11 of the folded product 2 and press these against the drive rollers 3.

The drawing device 12 has already drawn in the central region 13 of the folded product 2, so that the crosswise fold 14 is produced and the folded product 2 folded once. At the beginning of the drawing-in process the vertically mobile ram 31 is moved downwards and thereby presses the folded product 2 with the crosswise fold 14 into the drawing device 12. A compressed-air jet may also be used as an alternative to the ram 31 in order to introduce the folded product 2 into the drawing device 12. Further crosswise folding may be carried out, if required, in a drawing device 15 disposed after the drawing device 12.

Figure 2:
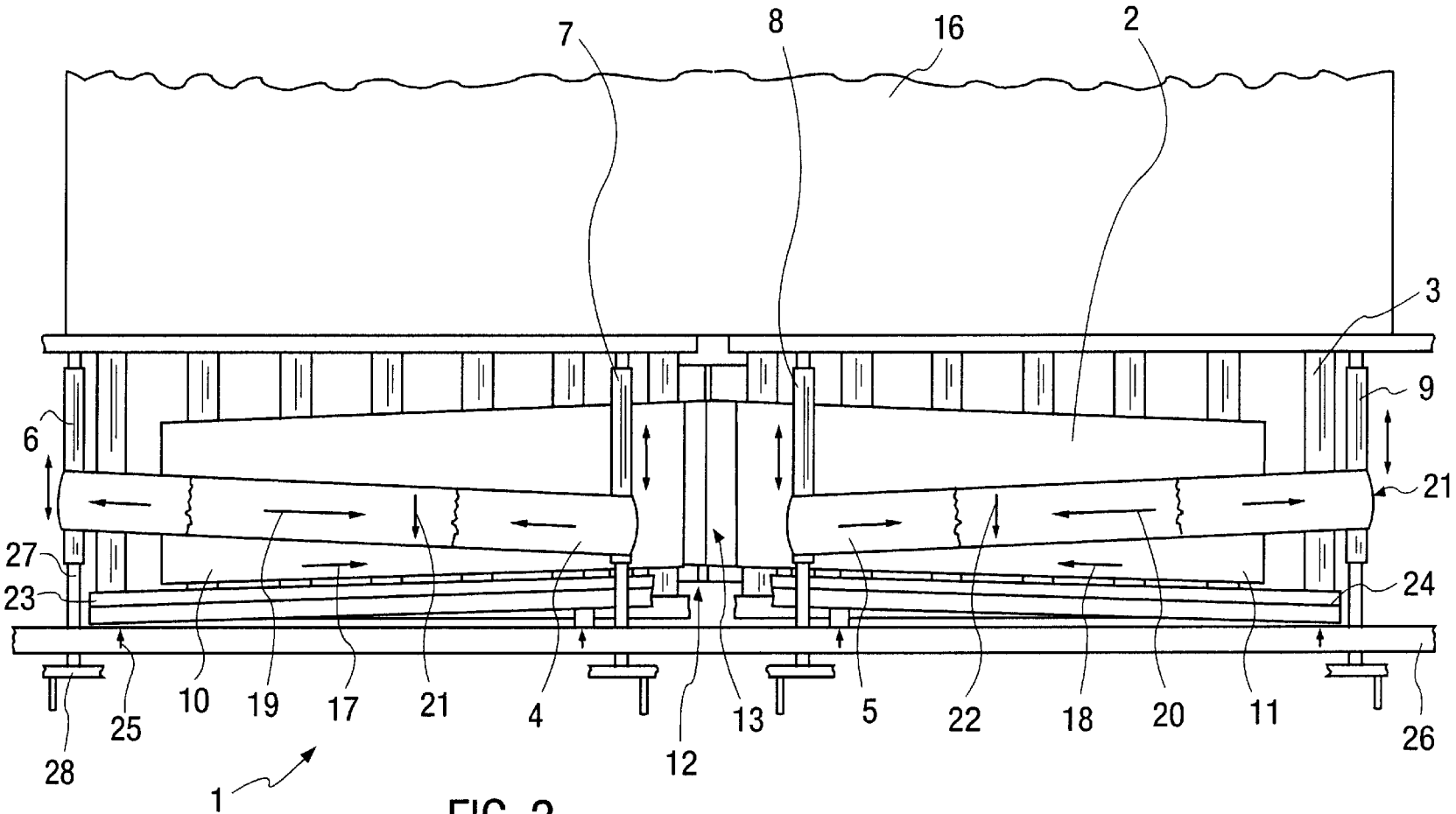
FIG. 2 is a diagrammatic representation of a folding apparatus viewed from above.

FIG. 2 is a view ofthe crosswise folding device 1 from above. The lengthwise folding device 16, which is only represented diagrammatically and in which the flat length of fabric is folded lengthwise, is disposed before the crosswise folding device 1. The conveying means and frame of the apparatus are only shown to the necessary extent in order to make the drawing more comprehensible.

The folded product 2, which has already been folded in tubular fashion in this state, lies on the drive rollers 3 and is pressed from above by the pressure belts 4 and 5 against the drive rollers 3. The central region 13 of the folded product 2 has already been drawn into the drawing device 12. The free ends 10 and 11 of the folded product 2 are thus drawn in towards the drawing device 12 in the direction of the movement arrows 17 and 18.

As the pressure belts 4 and 5 lying on the folded product 2 can roll freely on the deflecting rollers 6, 7, 8 and 9, they are driven by the folded product through frictional contact. The pressure belts 4 and 5 are shown in segmented form so that the resulting movement of these belts can be distinguished. The underside of the pressure belts 4 and 5 moves in the direction of the movement arrows 19 and 20 and the top side in the opposite direction.

The bearing surfaces of the deflecting rollers 6, 7, 8 and 9 each comprise a cambered region 21, over which the pressure belts 4 and 5 are centered. The cambered regions of the inner deflecting rollers 6 and 9 are disposed so as to be horizontally offset in the direction of the stop strips 23 and 24 relative to the cambered regions of the outer deflecting rollers 7 and 8. As a result of this offset arrangement of the spherical bearing surface regions, the direction of movement of the running belts 4 and 5 according to the movement arrows 19 and 20 is not parallel to the direction of movement of the free ends 10 and 11 of the folded product 2 according to the movement arrows 17 and 18. This angular offset of the movement arrows 19 and 20 relative to the movement arrows 17 and 18 gives rise to a thrust force which acts parallel to the force vectors 21 and 22 and is transmitted in planar fashion from the pressure belts 4 and 5 to the folded product 2 through frictional contact.

The planar thrust force acting parallel to the force vectors 21 and 22 causes the free ends 10 and 11 of the folded product 2 to be pressed with the outer lengthwise edge against stop strips 23 and 24.

The contact pressure of the lengthwise edges of the folded product 2 against the stop strips 23 and 24 is further intensified by disposing these two sections so as to extend obliquely relative to the direction of movement of the folded product. The stop strips 23 and 24 are secured to the frame 26 in four oblong holes 25, so that the orientation of the stop strips 23 and 24 can be altered in accordance with the folding task.

The deflecting rollers 6, 7, 8 and 9 are each mounted on a shaft 27 and can be displaced axially on the shaft 27 by turning the handwheel 28. The thrust force which acts on the folded product 2 through the angular offset between the folded product and the pressure belts can easily be altered by adjusting the deflecting rollers in this way.

While a specific embodiment of the invention has been shown and described in detail to illustrate the application of the principles of the invention, it will be understood that the invention may be embodied otherwise without departing from such principles.

What is claimed is:

1. An apparatus for folding a portion of a textile length, comprising:

a lengthwise folding device in which the portion of a textile length is folded to produce a tubular folded product with lengthwise folding edges extending substantially parallel to one another;

a crosswise folding device in which the tubular folded product is folded to produce a crosswise folded product in packet form with at least one crosswise folding edge extending substantially perpendicularly to the lengthwise folding edges;

a stop strip, wherein the tubular folded product can be brought to lie with at least a region of one lengthwise edge against said stop strip in the crosswise folding device before being folded;

a drawing device disposed in between two ends of the tubular folded product in order to draw in the tubular folded product for crosswise folding;

a thrust device disposed in said crosswise folding device, said thrust device being brought to lie against the tubular folded product while the tubular folded product is being drawn into the drawing device, said thrust device exerting a thrust force component directed substantially perpendicularly to said stop strip on the tubular folded product, said thrust device including at least one continuously circulating pressure belt on each side of the drawing device, said pressure belt being able to lie on the tubular folded product while the tubular article is being drawn in, said pressure belt traveling substantially slip-free with the tubular folded product in a direction toward said drawing device, wherein said pressure belt extends at an acute angle relative to a direction in which the tubular folded product is conveyved such that a horizontal distance between the stop strip and the pressure belt decreases in the direction toward the drawing device.

2. The apparatus according to claim 1, wherein said acute angle is between 0.01° to 10°.

3. The apparatus according to claim 2, wherein said acute angle is from and between 0.5° to 2°.

4. The apparatus according to claim 1, further comprising a substantially horizontal roller table with drive rollers disposed so as to extend substantially perpendicularly to the conveying direction of the tubular folded product, wherein when being drawn into the drawing device, the tubular folded product comes to lie on said table and is put into motion by means of the drive rollers.

5. The apparatus according to claim 1, wherein said pressure belt can be driven passively by means of frictional contact with the surface of the tubular folded product.

6. The apparatus according to claim 1, further comprising a substantially horizontal roller table with drive rollers disposed so as to extend substantially perpendicularly to the conveying direction of the tubular folded product, wherein when being drawn into the drawing device, the tubular folded product comes to lie on said table and is put into motion by means of the drive rollers, said pressure belt being deflected at inner and outer deflecting rollers which extend substantially parallel to the drive rollers of the roller table, said inner deflecting roller being arranged closer to said drawing device than said outer deflecting roller, wherein a central longitudinal axis of the pressure belt intersects the inner deflecting roller at a shorter distance from the stop strip than the outer deflecting roller.

7. The apparatus according to claim 6, wherein bearing surfaces of said deflecting rollers comprise an at least slightly cambered region on which the pressure belts are guided in the axial direction, related to the rotational axis of the deflecting rollers.

8. The apparatus according to claim 6, wherein one of said deflecting rollers is mounted so as to be axially adjustable in the direction of a corresponding rotational axis.

9. The apparatus according to claim 1, wherein said stop strip comprises two sections which are substantially symmetrical in relation to the drawing device and are disposed such that ends of the respective sections which point towards the drawing device are set at a setting angle towards the tubular folded product.

10. The apparatus according to claim 9, wherein said setting angle of said sections of said stop strip, related to the direction of conveying movement lie in the range between 0.1° and 20°.

11. The apparatus according to claim 9, further comprising a frame associated with said crosswise folding device, wherein said two sections of said stop strip can be secured to said frame of said crosswise folding device such that said setting angle can be adjusted.

12. An apparatus for folding an article, the apparatus comprising:

a lengthwise folding device in which the article is folded to produce a lengthwise folded article with a lengthwise folding edge;

a crosswise folding device in which the lengthwise folded article is folded to produce a packet form with a crosswise folding edge extending substantially perpendicularly to the lengthwise folding edge, said crosswise folding device including:

a drawing device disposed in a region between two ends of the lengthwise folded article in order to draw in the lengthwise folded article for crosswise folding;

said drawing device moves the lengthwise folded article in a direction;

a stop strip arranged adjacent said lengthwise edge of the lengthwise folded article;

a thrust device arranged against the lengthwise folded article and biasing the lengthwise edge of the lengthwise folded article against said stop strip when said drawing device is drawing in the lengthwise folded article for crosswise folding;

said thrust device includes a circulating pressure belt on opposite sides of said drawing device, said pressure belt being positionable on the lengthwise folded article while said drawing device draws in the lengthwise folded article, said pressure belt moving at an acute angle with respect to the stop strip.

13. The apparatus in accordance with claim 12, wherein:

horizontal distance between said circulating pressure belt and said stop strip decreases in a direction toward a center of said drawing device.

14. The apparatus in accordance with claim 13, wherein:

said circulating pressure belt travels substantially slip free with the lengthwise folded article in a direction toward of said drawing device.

15. The apparatus in accordance with claim 12, wherein:

said circulating pressure belt travels substantially slip free with the lengthwise folded article in a direction toward of said drawing device.

* * * * *